US010997827B2

(12) United States Patent
Nitz

(10) Patent No.: US 10,997,827 B2
(45) Date of Patent: May 4, 2021

(54) DISTRIBUTED AND DETERMINISTIC RANDOM NUMBER GENERATION FOR LOTTERY DRAWINGS

(71) Applicant: Multi-State Lottery Association, Urbandale, IA (US)

(72) Inventor: Robert J. Nitz, Ames, IA (US)

(73) Assignee: Multi-State Lottery Association, Urbandale, IA (US)

( * ) Notice: Subject to any disclaimer, the term of this patent is extended or adjusted under 35 U.S.C. 154(b) by 0 days.

(21) Appl. No.: 16/511,403

(22) Filed: Jul. 15, 2019

(65) Prior Publication Data

US 2021/0019981 A1 Jan. 21, 2021

(51) Int. Cl.
*G07F 17/32* (2006.01)

(52) U.S. Cl.
CPC ..... *G07F 17/329* (2013.01); *G07F 17/3225* (2013.01); *G07F 17/3241* (2013.01)

(58) Field of Classification Search
None
See application file for complete search history.

(56) References Cited

U.S. PATENT DOCUMENTS 6,887,152 B2 5/2005 Stanek
6,934,846 B2 8/2005 Szrek et al.
8,298,063 B2 10/2012 Packes, Jr. et al.
2007/0213125 A1 9/2007 Szrek et al.
2009/0042633 A1* 2/2009 Yacenda ..... G07F 17/32 463/17
2012/0178513 A1 7/2012 Jackson et al.
2012/0202574 A1* 8/2012 Stanek ..... G07F 17/3244 463/17
2015/0080114 A1 3/2015 Tipton et al.
2016/0337128 A1* 11/2016 Hamman ..... G03G 15/0928
2018/0275565 A1 9/2018 Hamman et al.

OTHER PUBLICATIONS

Medeleanu, F.; et al. (2016). Developing and Modeling a New E-lottery System Using Anonymous Signatures. "Mircea cel Batran" Naval Academy Scientific Bulletin, XIX(1):242-248.

* cited by examiner

*Primary Examiner* — Ronald Laneau
(74) *Attorney, Agent, or Firm* — Faegre Drinker Biddle & Reath LLP

(57) ABSTRACT

A method for operating a lottery through a plurality of lottery entities. Each of the lottery entities generates a respective plays hash of a set of play transactions issued by the entity for a lottery game, and a digital signature as a function of the plays hash, before a game drawing. Each of the plurality of lottery entities publishes the respective digital signature, followed by the respective plays hash, to other entities of the plurality of lottery entities and/or a central authority. A random number seed is generated as a function of the published plays hashes. One or more random draw numbers for the game drawing are generated as a function of the random number seed.

19 Claims, 5 Drawing Sheets

DISTRIBUTED AND DETERMINISTIC RANDOM NUMBER GENERATION FOR LOTTERY DRAWINGS

FIELD OF THE DISCLOSURE

The present disclosure relates generally to the generation of random numbers for lottery drawings.

BACKGROUND OF THE DISCLOSURE

Lottery games provide the public with the chance to win prizes, such as money, through the purchase of lottery tickets. The winning tickets are selected through a lottery drawing in which the winning lottery numbers are randomly generated. The numbers are typically generated using a specialized algorithm (i.e., a so-called random number generator) that takes a seed value as input and provides random numbers as outputs. Current lottery drawings using this specialized algorithm present various security challenges. For example, if the seed value becomes known, it may be possible to increase the chances of predicting random numbers using that seed value. As a result, a malicious actor with sufficient knowledge of the algorithm may perpetuate fraud by predicting the output and improperly becoming a winner. There remains a need to develop methods for generating random numbers for lottery drawings that are unpredictable, secure, and resistant to fraud.

SUMMARY OF THE DISCLOSURE

In one embodiment of the present disclosure, a method for operating a lottery through a plurality of lottery entities is provided. The plurality of lottery entities issue play transactions for one or more lottery games. The method includes causing each of the plurality of lottery entities to generate a respective plays hash of a set of play transactions issued by the entity for the one or more lottery games before game drawings for the one or more lottery games. The method also includes causing each of the plurality of lottery entities to generate a respective digital signature as a function of the respective plays hash before the game drawings. The method further includes causing each of the plurality of lottery entities to publish the respective digital signature to one or both of (1) other entities of the plurality of lottery entities or (2) a central authority, and to publish the respective plays hash to one or both of (1) the other entities of the plurality of lottery entities or (2) the central authority, after the publication of the respective digital signatures. Moreover, the method includes generating a random number seed as a function of the published plays hashes and generating a random draw number as a function of the random number seed for each of the one or more lottery games.

In one example, the method includes confirming that each of the plurality of lottery entities has published the respective digital signature before each of the plurality of lottery entities publishes the respective plays hash.

In another example, the method includes causing each of the plurality of lottery entities to publish the respective digital signature to an information processing system and to publish the respective plays hash to the information processing system after the publication of the respective digital signatures. In this example, generating the random number seed and the random draw number is also performed by the information processing system.

In a further example, the method includes transmitting the generated random draw number to each of the plurality of lottery entities.

In another embodiment of the present disclosure, a method for operating an information processing system to generate lottery draw numbers is provided. The method includes receiving, electronically from each of a plurality of lottery entities, a respective digital signature in advance of one or more game drawings for one or more lottery games. The respective digital signature is generated as a function of a respective plays hash generated by each of the plurality of lottery entities. The respective plays hash is a hash of a set of play information associated with play transactions issued by each of the plurality of lottery entities for the one or more game drawings. Each of the plurality of lottery entities publishes the respective digital signature to other entities of the plurality of lottery entities in advance of the one or more game drawings. The method also includes confirming that each of the plurality of lottery entities has published the respective digital signature. The method further includes receiving, electronically from each of the plurality of lottery entities, the respective plays hash after the confirmation that each of the plurality of lottery entities has published the respective digital signature. Moreover, the method includes generating a random number seed as a function of the received plays hashes and generating a random draw number as a function of the random number seed for each of the one or more lottery games.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

The variations will be more readily understood in view of the following description when accompanied by the below figures and wherein like reference numerals represent like elements, wherein.

DETAILED DESCRIPTION OF EMBODIMENTS

Preferred embodiments of the present disclosure are described below by way of example only, with reference to the accompanying drawings. Further, the following description is merely exemplary in nature and is in no way intended to limit the disclosure, its application, or uses. As used herein, the term "module" or "unit" may refer to, be part of, or include an Application Specific Integrated Circuit (ASIC), an electronic circuit, a processor or microprocessor (shared, dedicated, or group) and/or memory (shared, dedicated, or group) that executes one or more software or firmware programs, a combinational logic circuit, and/or other suitable components that provide the described functionality. Thus, while this disclosure includes particular examples and arrangements of the modules, the scope of the present system should not be so limited since other modifications will become apparent to the skilled practitioner.

Figure 1:
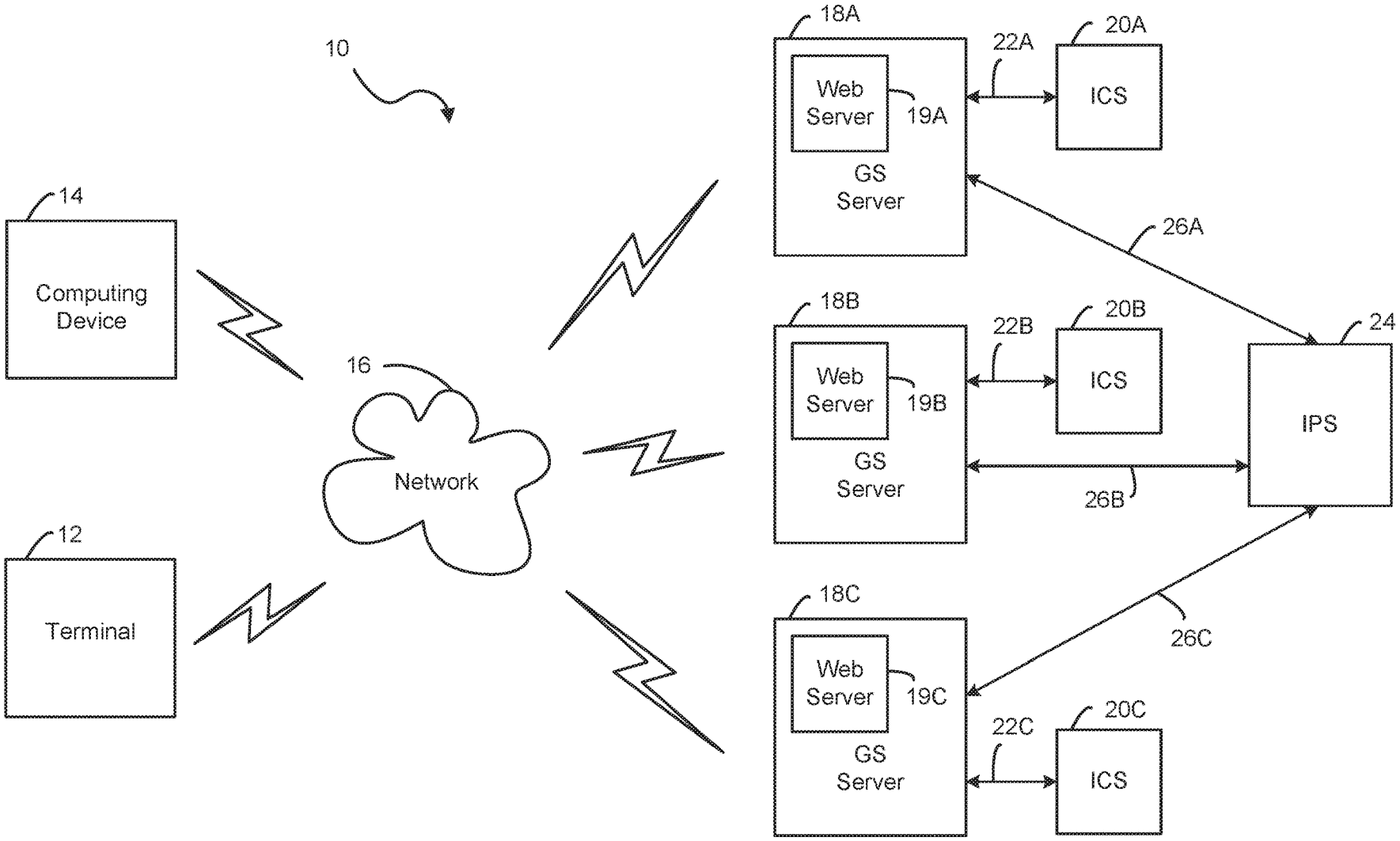
FIG. 1 is a schematic diagram of a lottery transaction processing system in accordance with embodiments of the present disclosure.

Referring now to FIG. 1, a lottery transaction processing system 10 includes a terminal 12 and a computing device 14 that are communicably connected to a gaming system (GS) server such as 18A, 18B, 18C (also designated 18 for any one of GS servers) via a network 16. Users can use the terminal 12 and/or the computing device 14 (e.g., a smartphone, a laptop, a desktop, a tablet, a smartwatch, etc.) to purchase lottery tickets. Winning lottery tickets can also be redeemed for payout at the terminal 12. As such, the terminal 12 can be installed as a point-of-sale terminal at retail stores. While only one terminal and computing device is shown in FIG. 1, any number of terminals and/or computing devices may be contemplated in other embodiments.

The GS servers 18A-18C are commonly provided by different lottery operating entities or jurisdictions (e.g., individual state lottery systems) to manage lottery games played in the jurisdictions by authorizing the issuance of lottery tickets and performing the validation and redemption of the lottery tickets. In one embodiment, the GS server 18A is associated with the state lottery system of a first jurisdiction (e.g., Illinois), the GS server 18B is associated with the state lottery system of a second jurisdiction (e.g., Michigan), and the GS server 18C is associated with the state lottery system of a third jurisdiction (e.g., Ohio). In some embodiments, each jurisdiction can have one or more GS servers 18. Each of the GS servers 18A, 18B, 18C is connected to a respective lottery internal control system (ICS) such as 20A, 20B, 20C (also designated 20 for any one of ICSs) via a respective network 22A, 22B, 22C. The ICSs 20A-20C provide support services to audit lottery ticket transactions including monitoring, logging, verifying, and balancing the transactions in real, or near-real time. In another example, each ICS 20A, 20B, 20C performs the validation and redemption of the lottery tickets in conjunction with a corresponding GS server 18A, 18B, 18C. While only three GS servers and ICSs are shown in FIG. 1, any number of GS servers and/or ICSs may be contemplated in other embodiments.

Each of the GS servers 18A, 18B, 18C is also connected to a lottery information processing system (IPS) 24 via a respective network 26A, 26B, 26C. The IPS 24 provides a centralized service for lottery game drawings, which involve the drawing of winning lottery numbers. The IPS 24 can be provided by a third-party entity. In embodiments, the IPS 24 is provided by a multi-state lottery association that is owned and operated by the various state lottery systems (i.e., a central authority).

Any suitable communication network is contemplated for the network 16, the networks 22A-22C, and the networks 26A-26C. For example, the terminal 12 and/or the computing device 14 can be communicably connected to a GS server 18 via the Internet 16. As another example, the GS servers 18A-18C can be communicably connected to the ICSs 20A-20C via local area networks (LANs) 22A-22C. As a further example, the GS servers 18A-18C can be communicably connected to the IPS 24 via wide area networks (WANs) 26A-26C. Other similar communication networks known in the art are also contemplated. Although shown as separate networks, parts or all of the networks 16, 22A-22C, and 26A-26C can be part of a common network.

Users, in a given jurisdiction, can play lottery games by purchasing lottery tickets. The users can purchase the lottery tickets using the terminal 12, which is configured to communicate with a GS server 18 of the given jurisdiction's lottery system (e.g., GS server 18A) to process the transactions. Interactions with the terminal 12 are facilitated by a human machine interface such as a keyboard, a touch sensitive pad or screen, a mouse, a trackball, a voice recognition system, and the like.

The users can also purchase the lottery tickets using the computing device 14. In this scenario, the GS server 18A includes a web server 19A which hosts a website that can be accessed by the computing device 14 using, for example, a uniform resource locator (URL). The web server 19A is configured to receive and process lottery ticket transaction requests from the computing device 14 via the network 16. Accordingly, the web server 19A can be used for the electronic issuance of the lottery tickets to the computing device 14. The web server 19A can be implemented as part of the GS server 18A or can be implemented in dedicated hardware coupled to the GS server 18A via local networks. In general, each of the GS servers 18A, 18B, 18C can have a respective web server 19A, 19B, 19C (also designated 19 for any one of web servers) as shown in FIG. 1.

The issuance of a purchased lottery ticket by a GS server 18 represents a play transaction. A lottery ticket can be issued in the form of a physical ticket (e.g., if purchased at the terminal 12, the terminal 12 can cause a printer to print out a physical copy) and/or an electronic ticket (e.g., if purchased using the computing device 14, the web server 19 can cause an electronic copy to be transmitted to the computing device 14). The issued lottery ticket includes various play information such as ticket identification data (e.g., a unique play serial number, a play random number key, etc.), draw numbers (e.g., selected by a user or a machine if the user did not request specific draw numbers), a draw date, and the like.

Lottery games can be played across multiple jurisdictions. That is, users in each participating jurisdiction can purchase tickets to play the same lottery game. As such, a set of play transactions for each jurisdiction (processed via the terminal 12 and/or the computing device 14) is stored at a GS server 18 of each jurisdiction's lottery system (e.g., GS servers 18A, 18B, 18C).

To complete the lottery game, a lottery drawing takes place in which the winning lottery numbers are randomly generated. Before the lottery drawing, each jurisdiction completes or closes the issuance or distribution of lottery tickets. For example, jurisdictions can close their draw pools at predetermined times. Following the completion of the lottery ticket distribution, and before the lottery drawing, each of the GS servers 18A-18C generates a plays hash of the set of play transactions stored at the GS server. The plays hash is a hash of all or a predetermined portion of the play information (e.g., unique play serial numbers, play random number keys, draw numbers, draw dates, etc.) associated with the set of play transactions. The plays hash can be generated using any suitable hashing methods such as a hash-based message authentication code (HMAC) method. Other suitable cryptographic methods, such as tag authentication techniques, are also contemplated.

After generating the plays hash, each of the GS servers 18A-18C generates a digital signature as a function of the plays hash. In one example, the digital signature is generated based on the HMAC method. As described in greater detail below, each of the GS servers 18A-18C publishes its digital signature to one or both of (1) each other GS server (e.g., to one or more of the other lottery entities), or (2) to the IPS 24 (e.g., to the central authority). After all the digital signatures are published, each GS server 18A-18C publishes its plays hash to one or both of (1) each other GS server (e.g., to one or more of the other lottery entities), or (2) to the IPS 24 (e.g., to the central authority). In embodiments, for example, each of the GS servers 18A-18C can determine that all the other GS servers have published their digital signatures by (1) confirming its receipt of the digital signature from each of the other GS servers, and/or (2) using a confirmation notification received from the IPS 24 that all the GS servers have published their digital signatures. In embodiments where the IPS 24 transmits notifications that all the GS servers 18A-18C have published their respective signatures, the notifications can include all of the published signatures. In embodiments, each of the GS servers 18A-18C has all the signatures from the other GS servers before it publishes its plays hash.

After the publication of the plays hashes, a random number seed is generated as a function of the published plays hashes. In embodiments, and as described in greater detail below, the IPS 24 generates the random number seed as a function of the received plays hashes following the publication of all the plays hashes. The random number seed is used for the lottery drawing. In embodiments, the IPS 24 generates one or more random numbers as a function of the random number seed. The randomly generated numbers represent the winning lottery numbers drawn for the common lottery game played across the multiple jurisdictions.

Figure 2:
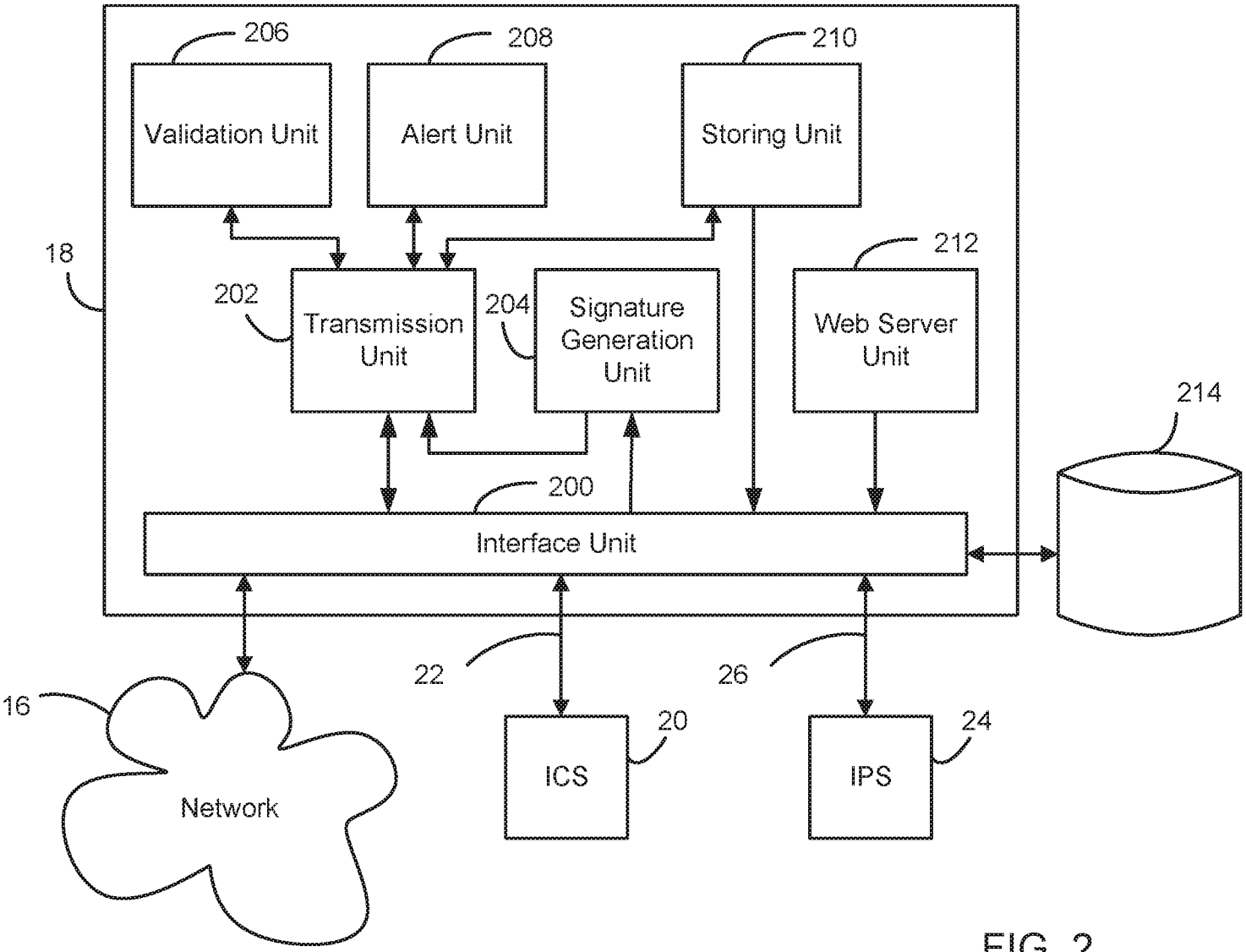
FIG. 2 is a schematic diagram of a gaming system server of the lottery transaction processing system of FIG. 1 in accordance with embodiments of the present disclosure.

Referring now to FIG. 2, an exemplary configuration of a GS server 18 is shown. The GS server 18 includes an interface unit 200, a transmission unit 202, a signature generation unit 204, a validation unit 206, an alert unit 208, a storing unit 210, and a web server unit 212. Although the units 200-212 are illustrated as children modules subordinate of the parent unit 18, each unit can be operated as a separate unit from the parent unit 18, and other suitable combinations of units are contemplated to suit different applications. One or more modules or units can be selectively bundled as a key software model running on the processor having software as a service (SaaS) features.

Data that is received and/or generated by the GS server 18 can be stored in a database 214 (e.g., as a non-transitory data storage device and/or a machine-readable data storage medium carrying computer-executable instructions). While FIG. 2 shows the database 214 as being independent or separate from the GS sever 18, in other embodiments, the database 214 is one of the units of the GS server 18.

The interface unit 200 is configured to provide a suitable interface between the units of the GS server 18, the network 16, an associated ICS 20, the IPS 24, and the database 214. The transmission unit 202 is configured to facilitate the delivery of data or information to/from: other units of the GS server 18, the database 214, various devices connected via the network 16 (e.g., terminal 12, computing device 14, other GS servers 18), the associated ICS 20 connected via the network 22, and the IPS 24 connected via the network 26.

The signature generation unit 204 is configured to generate a digital signature for a set of play transactions stored at the GS server 18 (e.g., stored at the database 214). To do so, the signature generation unit 204 generates a plays hash of the set of play transactions. In embodiments, the set of play transactions include information for all the lottery tickets issued by the GS sever 18 for one or more lottery games. The signature generation unit 204 then generates the digital signature as a function of the plays hash. The signature generation unit 204 is also configured to publish the plays hash and the digital signature to other GS servers 18 and the IPS 24. For example, the signature generation unit 204 instructs the transmission unit 202 to transmit the plays hash and the digital signature to one or more GS severs 18 via the network 16 and the IPS 24 via the network 26.

The validation unit 206 is configured to validate lottery tickets for redemption purposes. For example, by evaluating ticket identification data, the validation unit 206 determines whether tickets are authentic. The alert unit 208 is configured to inform a user or other systems of any detected errors during operation. For example, if the validation unit 206 determines that a ticket is not authentic, the validation unit 206 instructs the alert unit 208 to generate an error message to notify the user that validation has failed. The storing unit 210 is configured to store all relevant data in the database 214.

In embodiments where the user purchases lottery tickets using the computing device 14, the web server unit 212 is configured to receive and process lottery ticket transaction requests from the computing device 14. The web server unit 212 authorizes the issuance of the lottery tickets to the computing device 14.

Figure 3:
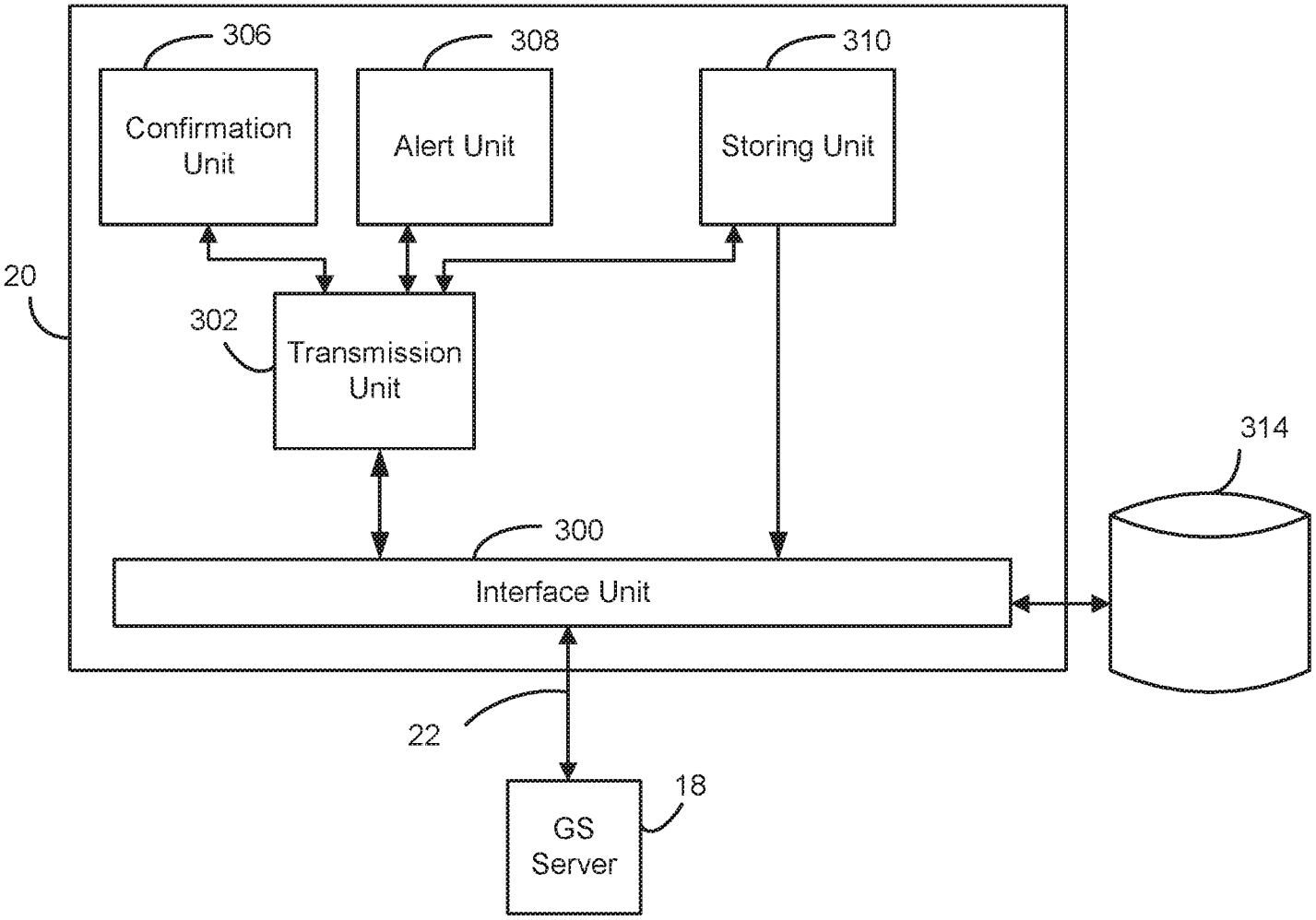
FIG. 3 is a schematic diagram of a lottery internal control system of the lottery transaction processing system of FIG. 1 in accordance with embodiments of the present disclosure.

Referring now to FIG. 3, an exemplary configuration of an ICS 20 is shown. The ICS 20 includes an interface unit 300, a transmission unit 302, a confirmation unit 306, an alert unit 308, and a storing unit 310. Although the units 300-310 are illustrated as children modules subordinate of the parent unit 20, each unit can be operated as a separate unit from the parent unit 20, and other suitable combinations of units are contemplated to suit different applications.

The interface unit 300 operates similarly to the interface unit 200. The transmission unit 302 is configured to facilitate the delivery of data or information to/from: other units of the ICS 20, a database 314 (which can be the same as the database 214 in FIG. 2 or can be a different database that operates similarly to the database 214), and a corresponding GS server 18 connected via the network 22.

The confirmation unit 306 is configured to confirm the validation of lottery tickets from the corresponding GS server 18. For example, the confirmation unit 306 confirms the authenticity of the tickets so that payouts can be issued. The alert unit 308 is configured to inform the user or other systems of any detected errors during operation (e.g., if payout cannot be made). The storing unit 310 is configured to store all relevant data in the database 314.

Figure 4:
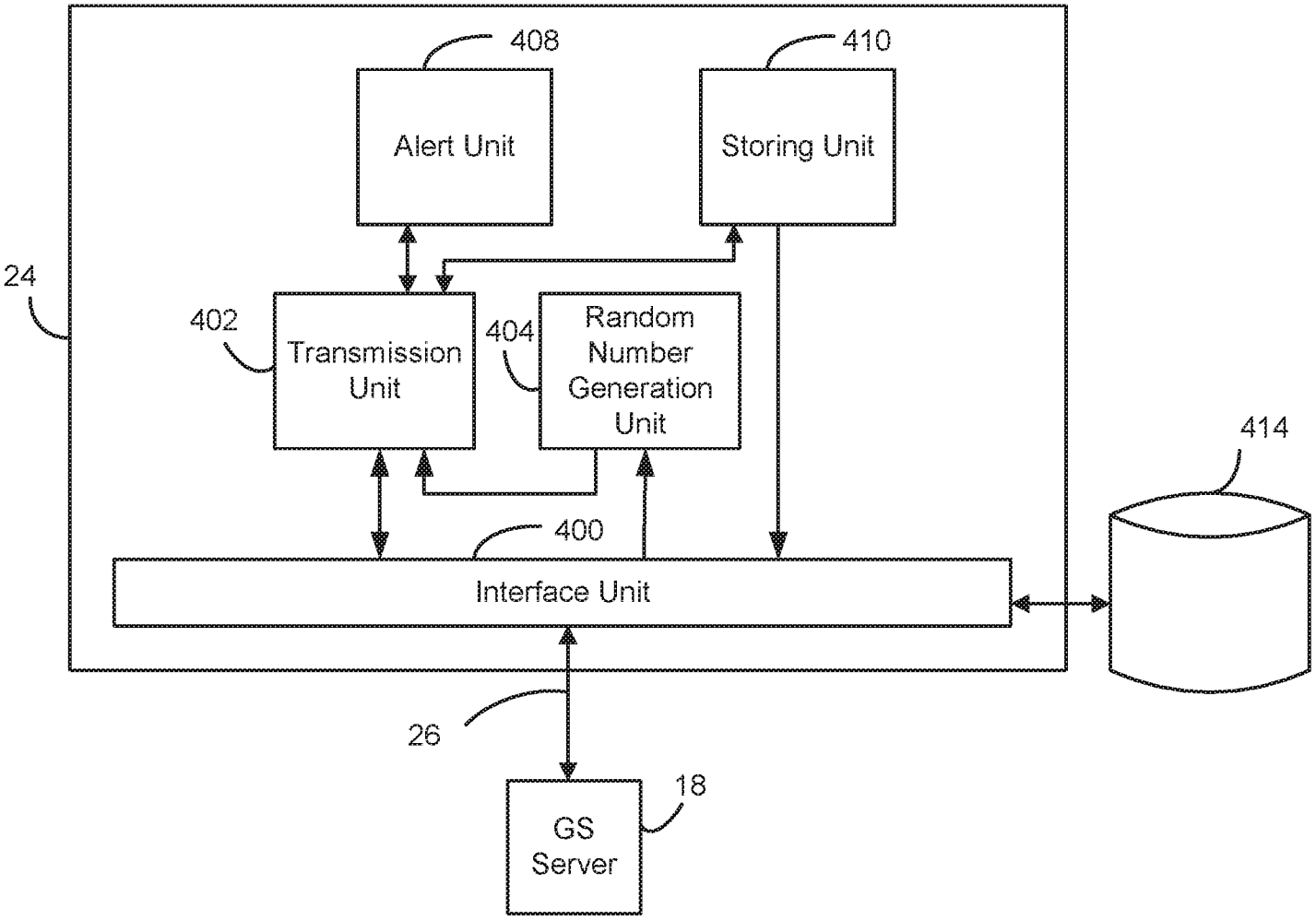
FIG. 4 is a schematic diagram of a lottery information processing system of the lottery transaction processing system of FIG. 1 in accordance with embodiments of the present disclosure.

Referring now to FIG. 4, an exemplary configuration of an IPS 24 is shown. The IPS 24 includes an interface unit 400, a transmission unit 402, a random number generation unit 404, an alert unit 408, and a storing unit 410. Although the units 400-410 are illustrated as children modules subordinate of the parent unit 24, each unit can be operated as a separate unit from the parent unit 24, and other suitable combinations of units are contemplated to suit different applications.

The interface unit 400 operates similarly to the interface units 200 and 300. The transmission unit 402 is configured to facilitate the delivery of data or information to/from: other units of the IPS 24, a database 414, and one or more GS servers 18 connected via the network 26.

The random number generation unit 404 is configured to generate random numbers for lottery drawings. In embodiments, the random number generation unit 404 is in the form of a pseudo-random number generator. Suitable pseudo-random number generators include those based on generalized feedback shift registers, lagged Fibonacci generators, mid-square generators, congruential generators, etc. A pseudo-random number generator uses a seed value to initialize a random number sequence generation. As such, the random number generation unit 404 generates a random number seed as a function of all the plays hashes received from the GS servers 18. The random number generation unit 404 then generates one or more random numbers as a function of the random number seed. The alert unit 408 is configured to inform the user or other systems of any detected errors during operation. The storing unit 410 is configured to store all relevant data in the database 414.

Figure 5:
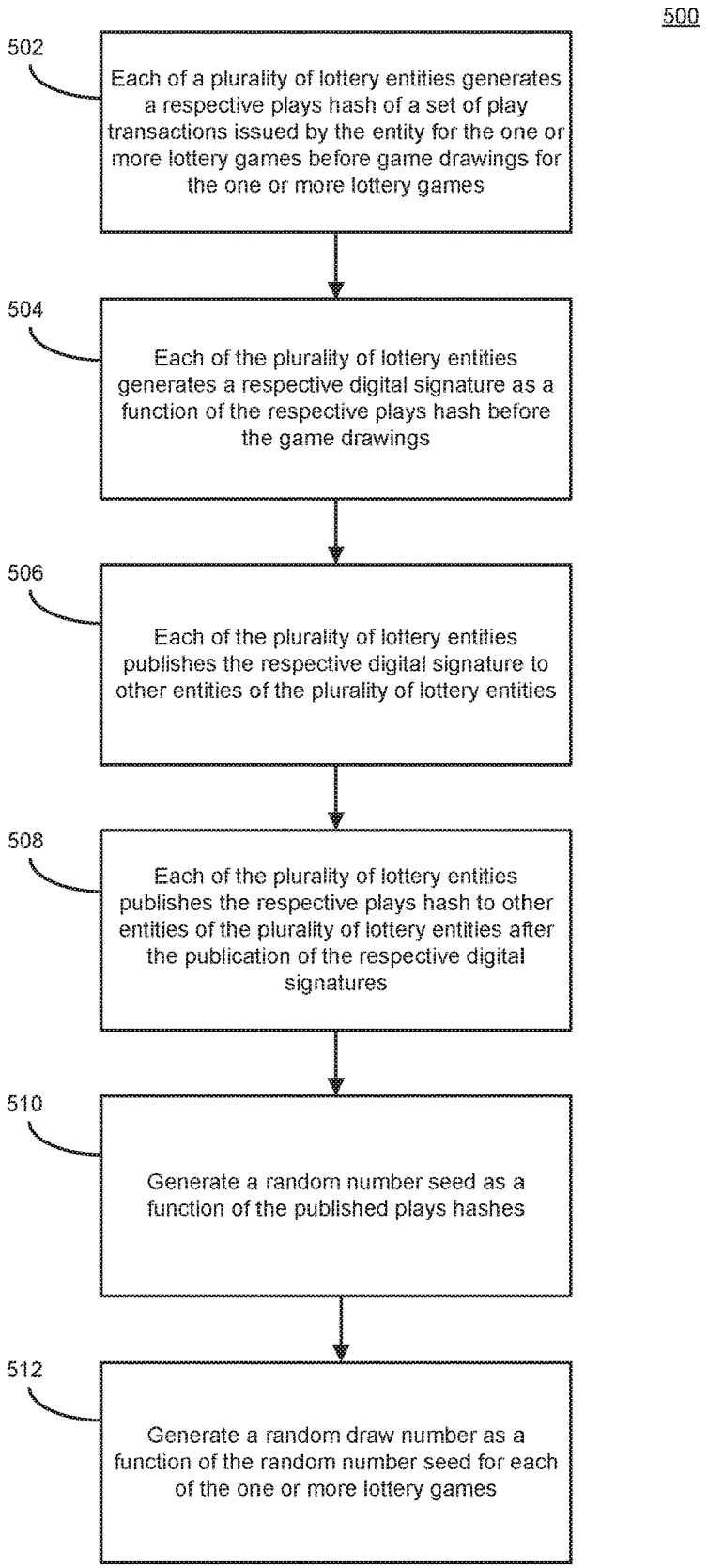
FIG. 5 is a flow chart of a random number generation method using the lottery transaction processing system of FIG. 1 in accordance with embodiments of the present disclosure.

Referring now to FIG. 5, an exemplary random number generation method 500 using the lottery transaction processing system 10 is shown. The method 500 is performed in a distributed manner by a plurality of lottery entities (e.g., GS servers 18A-18C provided by different lottery operating jurisdictions) and a lottery information processing system (e.g., IPS 24 of the central authority). The plurality of lottery entities issue play transactions for lottery games played within and across the different entities.

At step 502, each of the plurality of lottery entities operates to generate a respective plays hash of a set of play transactions issued by the entity for one or more lottery games. The respective plays hash is a hash of a set of play information (e.g., unique play serial numbers, play random number keys, draw numbers, draw dates, etc.) associated with the set of play transactions. The respective plays hash can be generated using any suitable hashing methods such as the HMAC method.

The respective plays hash is generated before game drawings for the one or more lottery games. The generation of the respective plays hash can be independently initiated by each of the plurality of lottery entities. For example, a GS server 18 can generate its plays hash when the period for issuing lottery tickets ends or at some other time prior to or in advance of the game drawing (e.g., after the close of the entity's draw pool). Alternatively, or additionally, the generation of the respective plays hash can be initiated by the lottery information processing system 24. For example, the IPS 24 can transmit instructions to each GS server 18 to begin generating each GS server's plays hash at some predetermined time prior to the game drawing.

At step 504, each of the plurality of lottery entities operates to generate a respective digital signature as a function of the respective plays hash. For example, the respective digital signature can be generated based on the HMAC method. The respective digital signature is also generated before the game drawings. The generation of the respective digital signature can be independently initiated by each of the plurality of lottery entities (e.g., after each GS sever 18 has finished generating its plays hash), or can be initiated by the lottery information processing system (e.g., the IPS 24 can transmit instructions to each GS server 18).

At step 506, each of the plurality of lottery entities operates to publish its respective digital signature to other entities of the plurality of lottery entities and/or to the central authority. At step 508, each of the plurality of lottery entities operates to publish its respective plays hash to other entities of the plurality of lottery entities and/or to the central authority after the publication of the respective digital signatures. As described above, these publications can be initiated by the plurality of lottery entities in conjunction with the lottery information processing system 24. For example, each GS server 18 can electronically transmit its generated digital signature to each other GS server as well as to the IPS 24. The IPS 24 can confirm that each GS server 18 has published its digital signature once the IPS 24 receives all the digital signatures from the GS servers. Alternatively or in addition, each GS server 18 can keep track of its receipt of the digital signatures from other GS servers, and confirm to the other GS servers its receipt of the digital signatures. The IPS 24 can transmit instructions to each GS server 18 indicating that each GS server 18 can now electronically transmit its generated plays hash to each other GS server as well as to the IPS 24. As described in greater detail below, the receipt of the digital signatures from all the lottery entities before the receipt of the plays hashes that will be used to generate the random number seed for the draw number provides a mechanism that can help minimize manipulation of the plays hashes and associated fraud in connection with the generation of the draw numbers.

At step 510, a random number seed is generated as a function of the published plays hashes. At step 512, one or more random numbers are generated as a function of the random number seed. The generated random numbers represent the random draw number for each of the one or more lottery games. In embodiments, the generation of the random number seed and the random draw numbers can be initiated and performed by the lottery information processing system 24. The lottery information processing system 24 further transmits the generated random draw number to each of the plurality of lottery entities. Other entities that are in receipt of the published plays hashes, such as for example the GS servers 18A-18C, can also generate the random number seed and the draw numbers.

In embodiments, the random number seed can be generated as a deterministic function of the plays hashes. As an example, the plays hashes can be ordered from the smallest to the largest. By this example, if all the lottery entities submitted SHA256 hashes, the resulting random number seed would have a length two hundred and fifty-six times the number of participating lottery entities. For games needed more entropy than two hundred and fifty-six bits, for example if the algorithm needed a re-seed, the original set of plays hashes could be re-ordered to generate a different seed. The GS servers 18A-18C and/or the IPS 24 can have knowledge of the function used to generate the random number seed from the plays hashes.

Embodiments of the disclosed methods offer important advantages. Because the digital signatures are received by the lottery entities and/or the central authority before the associated plays hashes, the lottery entities and/or the central authority can use the digital signatures to confirm the accuracy of the associated plays hashes. Accordingly, the lottery entities and/or the central authority can confirm or verify that all the received plays hashes have not been manipulated. If a lottery entity attempted to modify its plays hash after having knowledge of one or more plays hashes of other lottery entities, the digital signature of such a modified plays hash would not be valid. Use of the plays hashes to generate the random number seed according to the disclosed embodiments can therefore provide resistance to fraud, and enhance the unpredictability and security of the random number generation.

The above detailed description and the examples described therein have been presented for the purposes of illustration and description only and not for limitation. For example, the operations described can be done in any suitable manner. The methods can be performed in any suitable order while still providing the described operation and results. It is therefore contemplated that the present embodiments cover any and all modifications, variations, or equivalents that fall within the scope of the basic underlying principles disclosed above and claimed herein. Furthermore, while the above description describes hardware in the form of a processor executing code, hardware in the form of a state machine, or dedicated logic capable of producing the same effect, other structures are also contemplated. It is therefore contemplated that the present disclosure covers any and all modifications, variations or equivalents that fall within the spirit and scope of the basic underlying principles disclosed above and claimed herein.

What is claimed is:

1. A method for operating a lottery through a plurality of lottery entities that issue play transactions for one or more lottery games, comprising:

causing each of the plurality of lottery entities to operate one or more processors to generate a respective plays hash of a set of a plurality of play transactions issued by the entity for the one or more lottery games before game drawings for the one or more lottery games;

causing each of the plurality of lottery entities to operate one or more processors to generate a respective digital signature as a function of the respective plays hash before the game drawings;

causing each of the plurality of lottery entities to publish the respective digital signature to one or more of (1) other entities of the plurality of lottery entities or (2) a central authority;

causing each of the plurality of lottery entities to publish the respective plays hash to (1) one or more of the other entities of the plurality of lottery entities or (2) the central authority after the publication of the respective digital signature; and generating by one or more processors a random draw number as a function of the published plays hashes for each of the one or more lottery games.

2. The method of claim 1, further comprising confirming that each of the plurality of lottery entities has published the respective digital signature before the lottery entity published the respective plays hash.

3. The method of claim 1, further comprising causing each of the plurality of lottery entities to publish the respective digital signature to an information processing system.

4. The method of claim 3, further comprising causing each of the plurality of lottery entities to publish the respective plays hash to the information processing system after the publication of the respective digital signature.

5. The method of claim 4, wherein generating the random draw number is performed by the information processing system.

6. The method of claim 4 and further including confirming by one or more processors the accuracy of each received plays hash using the respective digital signature.

7. The method of claim 6 wherein confirming the accuracy of each plays hash includes confirming the accuracy of the plays hash before generating the random draw number.

8. The method of claim 1, further comprising transmitting the generated random draw number to each of the plurality of lottery entities.

9. The method of claim 1, wherein causing each of the lottery entities to publish the respective digital signature includes causing the lottery entity to publish the respective digital signature to both of (1) the other entities of the plurality of lottery entities and (2) the central authority.

10. The method of claim 9, wherein causing each of the lottery entities to publish the respective plays hash includes causing the lottery entity to publish the respective plays hash to both of (1) the other entities of the plurality of lottery entities and (2) the central authority.

11. The method of claim 10 wherein generating the random draw number is performed by the central authority.

12. The method of claim 1, wherein generating the random draw number includes generating the random draw number as a function of all of the published plays hashes.

13. The method of claim 1 wherein generating the random draw number includes:

generating by one or more processors a random number seed as a function of the received plays hashes; and generating by one or more processors the random draw number as a function of the random number seed.

14. A method for operating an information processing system to generate lottery draw numbers, comprising:

in advance of one or more game drawings for one or more lottery games, receiving by the information processing system, electronically from each of a plurality of lottery entities, a respective digital signature, wherein the respective digital signature is generated as a function of a respective plays hash generated by each of the plurality of lottery entities, wherein the respective plays hash is a hash of a set of play information associated with play transactions issued by the respective lottery entity for the one or more game drawings, and wherein each of the plurality of lottery entities publishes the respective digital signature to other entities of the plurality of lottery entities in advance of the one or more game drawings;

confirming that each of the plurality of lottery entities has published the respective digital signature;

receiving, electronically from each of the plurality of lottery entities, the respective plays hash after the lottery entity has published the respective digital signature; and generating by the information processing system a random draw number as a function of the received plays hashes for each of the one or more lottery games.

15. The method of claim 14, further comprising transmitting the generated random draw number to each of the plurality of lottery entities.

16. The method of claim 14 wherein generating the random draw number includes generating the random draw number as a function of the plays hashes from all of the plurality of lottery entities.

17. The method of claim 14 wherein generating the random draw number includes:

generating a random number seed as a function of the received plays hashes; and generating the random draw number as a function of the random number seed.

18. The method of claim 14 and further including confirming by the information processing system the accuracy of each received plays hash using the respective digital signature.

19. The method of claim 18 wherein confirming the accuracy of each plays hash includes confirming the accuracy of the plays hash before generating the random draw number.

* * * * *